US008939047B2

(12) United States Patent
Missfeldt et al.

(10) Patent No.: US 8,939,047 B2
(45) Date of Patent: Jan. 27, 2015

(54) PISTON COMPRESSOR

(75) Inventors: Peter Missfeldt, Kiel (DE); Peter Dahms, Schwedeneck (DE); Wolfgang Wiegers, Steinheim-Höpfigheim (DE)

(73) Assignee: J.P. Sauer & Sohn Maschinenbau GmbH, Kiel (DE)

( * ) Notice: Subject to any disclaimer, the term of this patent is extended or adjusted under 35 U.S.C. 154(b) by 215 days.

(21) Appl. No.: 13/435,566

(22) Filed: Mar. 30, 2012

(65) Prior Publication Data

US 2012/0251364 A1 Oct. 4, 2012

(30) Foreign Application Priority Data

Apr. 1, 2011 (EP) ..... 11002717

(51) Int. Cl.
*F16C 3/12* (2006.01)
*F04B 39/00* (2006.01)
*F04B 53/00* (2006.01)

(52) U.S. Cl.
CPC ..... *F04B 39/0094* (2013.01); *F04B 53/006* (2013.01)
USPC ..... 74/597

(58) Field of Classification Search
USPC ..... 74/595, 596, 597, 598
See application file for complete search history.

(56) References Cited

U.S. PATENT DOCUMENTS

| | | | | | |
|---|---|---|---|---|---|
| 852,447 | A | * | 5/1907 | Poehner | 74/598 |
| 1,690,296 | A | * | 11/1928 | Hirth | 74/598 |
| 2,190,411 | A | * | 2/1940 | Mattison | 74/597 |
| 2,471,982 | A | * | 5/1949 | Shulda | 74/597 |
| 2,566,785 | A | * | 9/1951 | Wheelis | 74/597 |
| 3,309,941 | A | | 3/1967 | Kappel | |
| 4,913,033 | A | * | 4/1990 | Bernas | 92/73 |

FOREIGN PATENT DOCUMENTS

| | | | |
|---|---|---|---|
| CH | 93 365 | A | 3/1922 |
| DE | 717 230 | C | 2/1942 |
| DE | 103 37 247 | A1 | 3/2005 |
| FR | 610 596 | A | 9/1926 |

* cited by examiner

*Primary Examiner* — Vicky Johnson
(74) *Attorney, Agent, or Firm* — McGlew and Tuttle, P.C.

(57) ABSTRACT

A piston compressor includes at least one piston which is coupled in movement to a crankshaft, the crankshaft being designed in an at least two-part manner. The at least two parts of the crankshaft are connected to one another by way of a cone connection.

17 Claims, 3 Drawing Sheets

PISTON COMPRESSOR

CROSS REFERENCE TO RELATED APPLICATIONS

This application claims the benefit of priority under 35 U.S.C. §119 of European Patent Application No. 11 002 717.4 filed Apr. 1, 2011, the entire contents of which are incorporated herein by reference.

FIELD OF THE INVENTION

The invention relates to a piston compressor.

BACKGROUND OF THE INVENTION

It is generally common to drive piston compressors via a crank drive. Hereby, the movement coupling of a piston of the piston compressor is effected with a crankshaft via a connecting rod mounted on a crank pin of the crankshaft. The connecting rod bearing as a rule is designed as an oil-lubricated plain bearing.

With dry-running piston compressors, the use of such oil-lubricated plain bearings is not possible. Here, instead of this, roller bearings have to be applied as connecting rod bearings. The crankshaft may be designed in a multi-part manner, i.e. as a so-called constructed crankshaft, in order to be able to assemble these roller bearings. After assembly of the bearings, the individual parts of the crankshaft are put together into the complete crankshaft. In this context, it is known to press the parts of the crankshaft to one another, which however has the disadvantage that it is then no longer possible without further ado, to dismantle the crankshaft again, in order e.g. to replace a bearing mounted on a crank pin as the case may be. It is further known to connect the parts of a crankshaft designed in a multipart manner with a positive fit by way of a Hirth serration. In this case, there is the possibility of separating the parts of the crankshaft from one another again, in a simple manner, in order e.g. to replace a defect roller bearing mounted on the crank pin, with a new one. However, the relatively large manufacturing effort and the comparatively high costs on manufacture of a Hirth serration which this effort entails have been found to be disadvantageous.

SUMMARY OF THE INVENTION

Against this background, it is the object of the invention, to provide a piston compressor with a crankshaft formed from several parts, whose parts may be releasably connected to one another in a simple and inexpensive manner.

This object is achieved by a piston compressor with the features specified in the claims. Advantageous further developments of this piston compressor are to be deduced from the dependent claims, the subsequent description as well as the drawing. Hereby, according to the invention, the features specified in the dependent claims, in each case per se, but also in a technically meaningful combination, may further form the solution according to the invention and according to the claims.

The piston compressor according to the invention comprises at least one piston which is coupled in movement to a crankshaft. The crankshaft is designed of at least two parts. Hereby, usefully such a division of the crankshaft is envisaged, with which at least a first part of the crankshaft forms a free end of a crank pin of the crankshaft in the non-assembled condition of the crankshaft, whilst a crank web bordering the crank pin is formed on the second part of the crankshaft. All parts of the crankshaft may for example be designed as cast parts or forged parts. The free end of the first part of the crankshaft permits a roller bearing to be arranged on the crank pin before the assembly of the crankshaft.

According to the invention, the at least two parts of the crankshaft are connected to one another by way of a cone connection. Accordingly, with regard to manufacturing technology, the end of one of the parts to be connected to one another is designed in a cone-shaped or truncated-cone-shaped manner and the other part correspondingly with a hollow-cone-shaped recess. For connecting the two parts, the first part is simply inserted with the cone-shaped end into the hollow-cone-shaped recess of the second part, and the two parts are subsequently clamped (tightened) to one another, wherein the two parts are self-centering in the axial direction and only the one component needs to be aligned to the other component with regard to the demanded angle alignment of the two crank webs which are adjacent the crank pin. The design of the crankshaft according to the invention not only permits a rapid and simple assembly of the crankshaft for the first time, but also later disassemblies for maintenance and repair purposes.

Preferably, one envisages a crank pin and a crank web of the crankshaft being connected by way of the cone connection. Accordingly, one end of a first part of the crankshaft is formed by a crank pin, whilst a crank web forms one end of a second part of the crankshaft. For forming a cone connection between the first and the second part of the crankshaft or between the crank pin and the crank web, preferably the free end of the crank pin hereby tapers conically, whilst a cone-shaped recess which extends transversely to the longitudinal extension of the crank web is formed on the outside on the crank web which forms one end of the second part of the crankshaft.

Particularly favorably, the first and the second part of the crankshaft are screwed to one another. Thus one advantageously envisages the regions of the crank pin and the crank web which form the cone connection being clamped by way of a screw. This screw is usefully arranged and aligned in a manner such that with a screw movement for clamping the cone connection, it pulls the conical end of the crank pin into the recess formed on the crank web.

With a cone connection between the crank pin and the crank web which is clamped by way of screwing, a design is preferred, with which the screw engages through the crank web in the axial direction of the crank pin and engages into an end region of the crank pin. i.e., preferably a threaded pocket hole is formed in the crank pin, whilst a through-bore is formed in the crank web and extends in the axial direction of the crank pin and transversely to the longitudinal extension direction of the crank web completely through the crank web. As soon as the conical end of the crank pin engages into the conical recess formed on the crank web, the through-bore formed on the crank web, and the threaded pocket hole formed on the crank pin, are aligned, so that a screw led through the through-bore of the crank web may now be screwed in the threaded pocket hole of the crank pin, wherein a head of the screw which comes to bear on the crank web presses the crank web against the crank pin and clamps the crank web with the crank pin. The through-hole preferably has a larger diameter than the screw, so that this has play in the through-hole and the centering is effected via a cone connection.

In a further development of this design, the screw engages into the crank pin preferably in a central manner. Accordingly, a middle axis of the crank pin and a middle axis of the threaded pocket-hole formed on the crank pin correspond to one another. The screw forms a rotation pivot, about which the second part of the crankshaft with the crank web may be rotated with respect to the first part of the crankshaft with the crank pin and vice versa for the exact alignment of the first part relative to the second part, given a screw which is not completely screwed in. As soon as the two parts of the crankshaft have the required alignment, the screw may be completely screwed, i.e. the end of the crank pin may be fixedly clamped in the crank web. Thereby, a first fixation of the angular position is effected by the friction fit in the cone connection. A decentral arrangement in the crank pin is also possible instead of a central arrangement of the screw.

After this alignment of the second part of the crankshaft relative to the first part of the crankshaft has been effected, the position of the second part of the crankshaft may typically no longer change with respect to the first part of the crankshaft. For this purpose, the connection of the crank web and the crank pin is advantageously secured by way of an additional rotation lock. The rotation lock is usefully formed by positive-fit elements which simultaneously engage into the crank web and the crank pin essentially transversely to a possible rotation direction of the second part of the crankshaft relative to its first part.

Preferably, at least one securing pin engaging through the crank web and engaging into the crank pin forms the rotation lock. With this design, usefully a bore is formed on the crank web, and a pocket hole is formed on the crank pin, wherein the pocket hole on the crank pin is arranged in the direct extension to the bore on the crankshaft, i.e. is arranged with the same axis as the bore of the crank web, given a correct alignment of the first part of the crankshaft relative to its second part.

Particularly advantageously, one envisages the at least one securing pin engaging through the crank web in a manner radial distanced to the screw and axially parallel to the crank pin, and engaging into the crank pin. Accordingly, the securing pin is led in a bore which departing from the side of the crank web which is away from the crank pin, extends laterally next to the screw for clamping the two parts of the crankshaft, and parallel to a longitudinal axis of this screw as well as parallel to the middle axis of the crank pin through the crank web and into the crank pin which is adjacent thereon. The securing pin is simultaneously also arranged axially parallel to a rotation axis of the crankshaft by way of the securing pin being arranged axially parallel to the crank pin. This is favorable inasmuch as the securing pin is aligned transversely to the moments to be transmitted.

In order to reduce the torque loading acting on the securing pin on operation of the crankshaft, preferably two securing pins are provided. These two securing pins are advantageously aligned axially parallel to the crank pin and are preferably arranged in a manner that they engage into the crank pin in a manner lying diametrically opposite one another. The bores which lead through the crank web into the crank pin and which are for receiving the securing pins thus both extend in a plane, in which the middle axis of the crank pin also lies, wherein the two securing pins are arranged on two opposite sides of the middle axis of the crank pin and preferably each have an equal distance to the middle axis of the crank pin.

With regard to manufacturing technology, the bore for receiving the at least one securing pin is preferably formed after the assembly of the cone connection, i.e. after the alignment of the two parts of the crankshaft and their clamping to one another. Thus the bore in the crankshaft and the pocket hole in the crank pin may be simultaneously designed aligned to one another. The bore or bores for receiving the securing pin or the securing pins are thus manufactured when the two parts of the crankshaft have their final position to one another. Advantageously, they may then each be created in a quick and easy manner in one drilling procedure.

According to a further advantageous design, adjustment surfaces are formed on each of the parts of the crankshaft which are to be connected to one another, for the relative alignment of these parts to one another. With regard to these adjustment surfaces, it is in each case the case of plane surfaces on an outer side of these parts of the crankshaft, which are arranged such that the parts of the crankshaft which are to be connected to one another have exactly the required alignment to one another when the adjustment surfaces lie on a plane reference surface.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
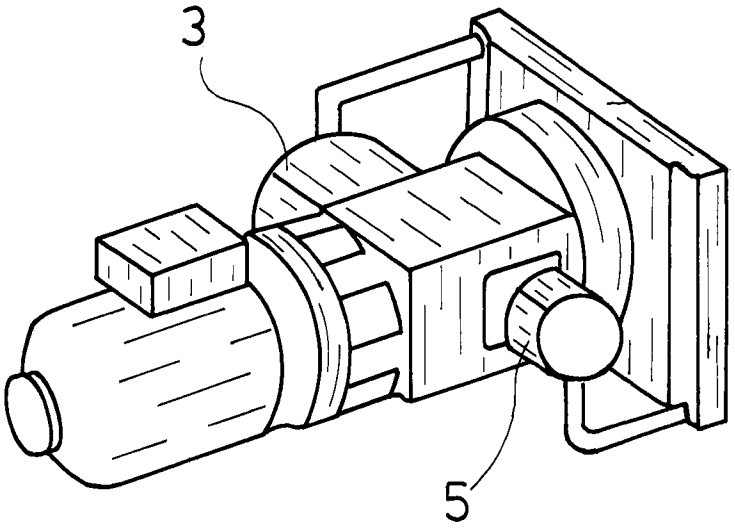
FIG. 1 is a perspective view of a piston compressor.
Figure 2:
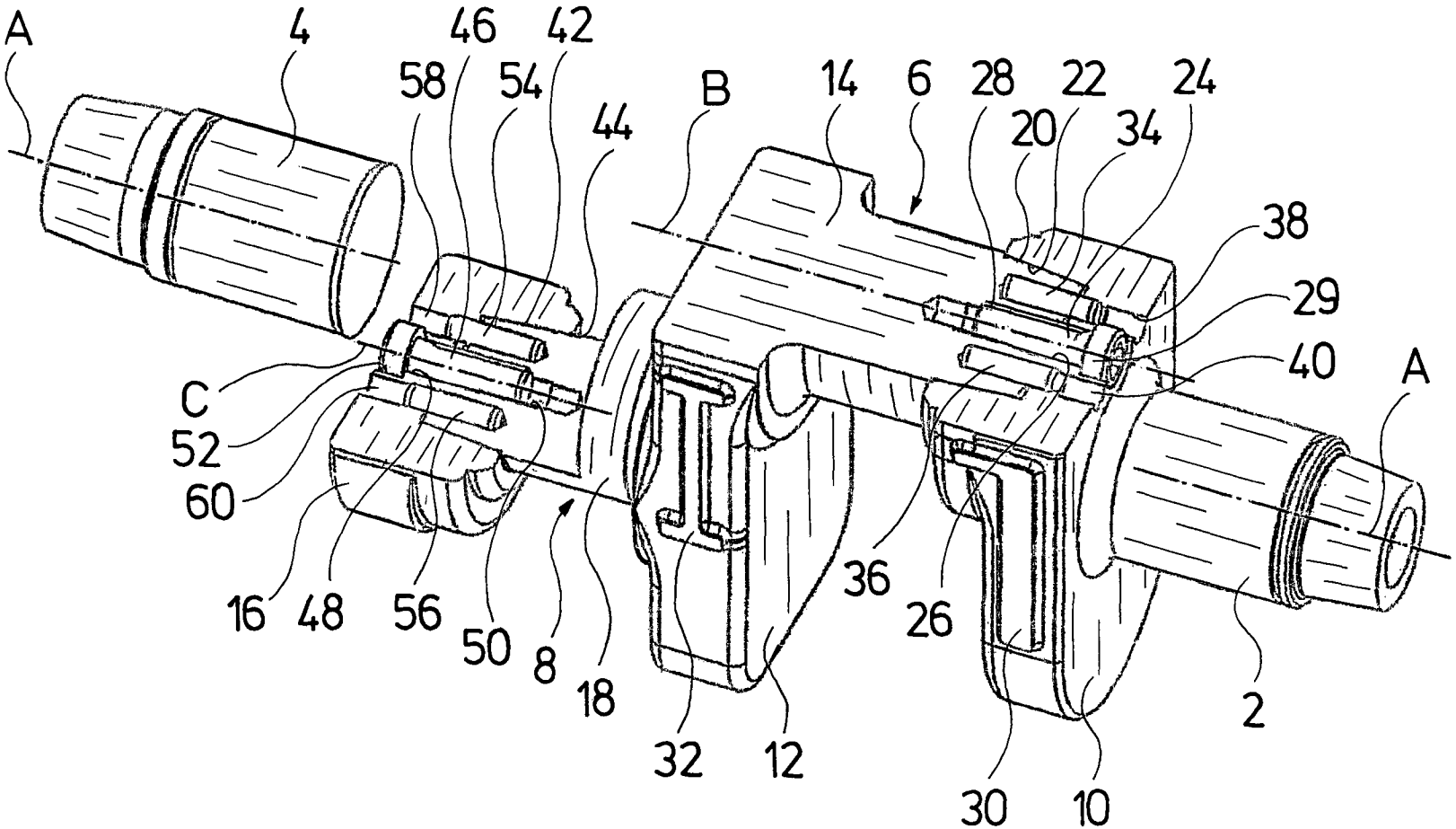
FIG. 2 is a perspective, partly sectioned, view of a crankshaft of the piston compressor according to FIG. 1.

With regard to the piston compressor represented in FIG. 1, it is the case of a two-stage, dry-running piston compressor with two cylinders 3 and 5. For the drive of the pistons arranged in these cylinders 3 and 5, the pistons are each coupled in movement via a non-represented connecting rod to the crankshaft represented in FIG. 2.

The outer ends of this crankshaft are formed by shaft journals 2 and 4 which define a rotation axis A of the crankshaft. The crankshaft comprises two cranks 6 and 8 between the shaft journals 2 and 4. The first crank 6 of the crankshaft which connects directly onto the shaft journal 2 is formed by two crank webs 10 and 12 which with respect to the shaft journal 2 and 4 project radially outwards and which via a crank pin 14 whose middle axis B is distanced radially to the common middle axis A of the shaft journals 2 and 4, are connected to one another. The second crank 8 is formed by a crank web 12, a further crank web 16 aligned parallel to the crank web 12 as well as by a crank pin 18 connecting the two crank webs 12 and 16. A middle axis C of the crank pin 18, in the opposite radial direction to the middle axis B of the crank pin 14 is radially distanced to the middle axis A of the shaft journals 2 and 4.

The crankshaft is designed in a three-part manner. Thus the shaft journal 2 and the crank web 10 form a first part of the crankshaft, the crank pin 14 with the crank web 12 and with the crank pin 18 a second part of the crankshaft, and the crank web 16 and the shaft journal 4 a third part of the crankshaft. The three parts of the crankshaft are in each case connected by way of cone connections. The three-part design of the crankshaft permits roller bearings to be assembled on the crank pins 14 and 18.

For forming a cone connection between the first and the second part of the crankshaft, an end section 20 of the crank pin 14 tapers in a conical manner. Corresponding to this, a recess 22 is formed on the crank web 10 at the side which is away from the shaft journal 2 and this recess likewise tapers in a conical manner. The crank pin 14 with its end section 20 engages into the recess 22 formed on the crank web 10. In this position, the crank pin 14 is clamped to the crank web 10 with a screw 24.

This screw 24, departing from the side which faces the shaft journal 2, extends through the crank web 10 and engages into the crank pin 14 at the end-side. For this, a bore 26 which extends transversely to the longitudinal extension of the crank web 10 through the crank web 10 is formed on the crank web 10. Departing from the end-side, a threaded pocket hole 28 on the crank pin 14 extends in the direction of the middle axis B of the crank pin 14. An end section 29 of the bore 26 which faces the shaft journal 2 is designed in a radially widened manner and serves for receiving a screw head of the screw 24 designed as a hexagonal socket screw.

In order to ensure that the first part of the crankshaft has the desired alignment to the second part of the crankshaft, in each case adjustment surfaces 30 and 32 are formed on the crank webs 10 and 12 on an outer side aligned essentially transversely to the middle axis B of the crank pin 14. With a correct alignment of the first and the second part of the crankshaft, the adjusting surfaces 30 and 32 lie in a plane manner on a plane reference surface which is not shown.

The connection of the crank pin 14 to the crank web 10 is secured by way of a rotation lock. The rotation lock is formed by two securing pins 34 and 36 which in each case are arranged in a bore penetrating the crank web 10 and engaging into the crank pin 14. Thus the securing pin 34 is arranged in a bore 38, and the securing pin 36 in a bore 40. The middle axes of the bores 38 and 40 lie in a common plane with the middle axis B of the crank pin 14, wherein the bores 38 and 40 are arranged on opposite sides of the screw 24 and lying diametrically opposite one another, radially distanced to the screw 24. The bores 38 and 40 for receiving the securing pins 34 and 36 are formed in a particularly simple manner in the assembled condition of the crankshaft which is shown in the drawing, i.e. when the second part of the crankshaft with the crank pin 14 and the first part of the crankshaft with the crank web 10 are clamped to one another by way of the screw 24, and the first and second part of the crankshaft have the required relative alignment to one another. By way of this, the sections of the bores 38 and 40 which are provided in the crank web 10 and in the crank pin 14 may be formed in each case together in one drilling procedure.

The cone connection between the second and the third part of the crankshaft corresponds essentially to the cone connection between the first and the second part of the crankshaft. An end-section 42 of the crank pin 18 which is away from the crank web 12 tapers in a conical manner. Corresponding to the conical end section 42 of the crank pin 18, a hollow-cone-shaped recess 44, into which the conical end-section 42 of the crank pin 18 engages, is formed on the crankshaft 16 on the side which is away from the shaft journal 4.

The second part of the crankshaft is clamped to the third part of the crankshaft by way of a screw 46 which is designed as a hexagonal socket screw just as the screw 24. A bore 48 is formed on the crank web 16, and a threaded pocket hole 50 is formed on the crank pin 18 on the end-side, for receiving the screw 46. A common middle axis of the bore 48 and the threaded pocket hole 50 corresponds to the middle axis C of the crank pin 18. An end section 52 of the bore 48 is designed in a radially widened manner for receiving a screw head of the screw 46.

Figure 3:
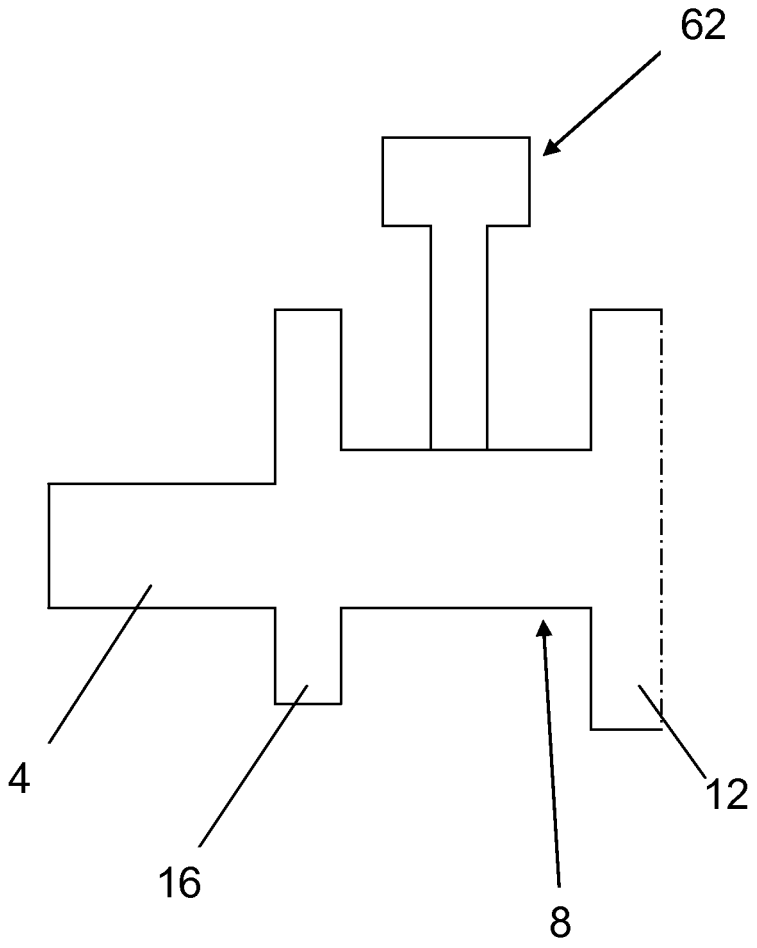
FIG. 3 is a partial side view of the crankshaft of FIG. 2.

The connection of the crank pin 18 to the crank web 16 is secured against an undesired rotational movement of the two parts relative to one another by way of a rotation lock in the form of securing pins 54 and 56. The securing pin 54 is arranged in a bore 58 and the securing pin 56 is arranged in a bore 60. The bores 58 and 60 are arranged lying diametrically opposite one another at a radial distance at opposite sides of the screw 46. The middle axes of the bores 58 and 60 lie in a common plane with the middle axis C of the crank pin 18. The bores 58 and 60 are usefully also formed in the assembled condition of the crankshaft, specifically when the third part of the crankshaft is connected to the second part of this. FIG. 3 is a partial side view of the crankshaft of FIG. 2. A piston 62 is connected to the crank web 12.

While a specific embodiment of the invention has been shown and described in detail to illustrate the application of the principles of the invention, it will be understood that the invention may be embodied otherwise without departing from such principles.

What is claimed is:

1. A piston compressor, comprising:

a crankshaft;

at least one piston which is coupled in movement to said crankshaft, said crankshaft being designed in an at least two-part manner, the at least two parts of the crankshaft being connected to one another via a cone connection, wherein adjustment surfaces are formed on each of the parts of the crankshaft which are to be connected to one another, for the relative alignment of the parts to one another, said adjustment surfaces being arranged in a same plane with said parts being in alignment with each other, each of said adjustment surfaces being located at a spaced location from at least a portion of a respective one of said parts, one of said adjustment surfaces comprising a first portion, a second portion and a third portion, said first portion being parallel to said third portion, said second portion being perpendicular to said first portion and said third portion, another one of said adjustment surfaces comprising another adjustment surface first portion and another adjustment surface second portion, said another adjustment surface first portion being perpendicular to said another adjustment surface second portion.

2. A piston compressor according to claim 1, wherein a crank pin and a crank web of the crankshaft are connected via the cone connection.

3. A piston compression according to claim 2, wherein regions of the crank pin and of the crank web which form the cone connection are clamped via a screw.

4. A piston compressor according to claim 3, wherein the screw engages through the crank web in an axial direction of the crank pin and said screw engages into an end-section of the crank pin.

5. A piston compressor according to claim 4, wherein the screw engages centrally into the crank pin.

6. A piston compressor according to claim 3, wherein the screw engages centrally into the crank pin.

7. A piston compressor according to claim 2, wherein connection of the crank web and the crank pin is secured via a rotation lock.

8. A piston compressor according to claim 7, wherein at least one securing pin forms the rotation lock, said at least one securing pin engaging through the crank web and said at least one securing pin engaging into the crank pin.

9. A piston compressor according to claim 8, wherein a bore is provided in the crank pin and the crank web, for receiving the at least one securing pin, said bore having been formed after assembly of the cone connection.

10. A piston compressor according to claim 8, wherein the at least one securing pin engages through the crank web in a manner radially distanced to a screw and axially parallel to the crank pin, and said at least one securing pin engages into the crank pin.

11. A piston compressor according to claim 7, wherein two securing pins are provided, which are arranged in a manner such that said two securing pins engage into the crank pin in a manner lying diametrically opposite one another.

12. A piston compressor, comprising:

a crankshaft comprising a crank pin, a first crank web and a second crank web, said crank pin having a conically tapered end section and a crank pin longitudinal axis, said first crank web having a conically tapered recess, said conically tapered recess receiving at least a portion of said conically tapered end section, said first crank web comprising a first crank web adjustment structure, said first crank web adjustment structure comprising a first crank web adjustment structure surface, said first crank web adjustment structure surface being located at a radially spaced location from at least a portion of said first crank web with respect to said crank pin longitudinal axis, said second crank web comprising a second crank web adjustment structure, said second crank web adjustment structure comprising a second crank web adjustment structure surface, said second crank web adjustment structure surface being located at a radially spaced location from at least a portion of said second crank web with respect to said crank pin longitudinal axis;

a piston connected to said crankshaft, said crankshaft comprising another crank pin and another crank web, said another crank pin having another conically tapered end section, said another crank web having another conically tapered recess, said another conically tapered recess receiving at least a portion of said another conically tapered end section, wherein said first crank web adjustment structure surface and said second crank web adjustment structure surface are arranged in a same plane with said first crank web aligned with said second crank web, said first crank web adjustment structure surface comprising a first portion, a second portion and a third portion, said first portion being parallel to said third portion, said second portion being perpendicular to said first portion and said third portion, said second crank web adjustment structure surface comprising a second crank web adjustment structure surface first portion and a second crank web adjustment structure surface second portion, said second crank web adjustment structure surface first portion being perpendicular to said second crank web adjustment structure surface second portion, said first crank web adjustment structure and said second crank web adjustment structure defining a means for aligning said first crank web with said second crank web.

13. A piston compressor according to claim 12, further comprising:

a screw, said crank pin having a first crank pin recess, said crank web comprising a first crank web recess, said first crank pin recess being aligned with said first crank web recess, wherein at least a portion of said screw extends through said first crank pin recess and said first crank web recess, one portion of said screw engaging said crank pin and another portion of said screw engaging said crank web;

a securing pin, said crank pin having a second crank pin recess, said crank web having a second crank web recess, said second crank pin recess being aligned with said second crank web recess, at least a portion of said securing pin extending through said second crank pin recess and said second crank web recess, one portion of said securing pin engaging said crank pin and another portion of said securing pin engaging said crank web, wherein said crank pin and said crank web are rotationally locked via said securing pin.

14. A piston compressor according to claim 13, further comprising:

another screw, said another crank pin having a first another crank pin recess, said another crank web comprising a first another crank web recess, said first another crank pin recess being aligned with said first another crank pin recess, wherein at least a portion of said another screw extends through said first another crank pin recess and said first another crank web recess, one portion of said another screw engaging said another crank pin and another portion of said another screw engaging said another crank web;

another securing pin, said another crank pin having a second another crank pin recess, said another crank web having a second another crank web recess, said second another crank pin recess being aligned with said second another crank web recess, at least a portion of said another securing pin extending through said second another crank pin recess and said second another crank web recess, one portion of said another securing pin engaging said another crank pin and another portion of said another securing pin engaging said another crank web, wherein said another crank pin and said another crank web are rotationally locked via said another securing pin.

15. A piston compressor, comprising:

a crankshaft comprising a first part, a second part, a third part, a first adjustment structure and a second adjustment structure, said first part comprising an outer surface, said outer surface defining a conically tapered end portion, said second part having an inner surface and a second part outer surface, said inner surface defining a conically tapered recess, at least a portion of said conically tapered end portion being inserted into said conically tapered recess to form a cone connection, wherein said first part is connected to said second part via at least said cone connection, said third part being connected to said first part, said first adjustment structure being connected to said second part, said first adjustment structure comprising a first adjustment structure surface, said first adjustment structure surface being located at a spaced location from at least a portion of said second part outer surface, said second adjustment structure being connected to said third part, said third part having a third part outer surface, said second adjustment structure comprising a second adjustment structure surface, said second adjustment structure surface being located at a spaced location from at least a portion of said third part outer surface, wherein said first adjustment structure and said second adjustment structure define an alignment indication means for indicating an alignment of said third part with said second part;

a piston connected to said crankshaft, said first part comprising a first crank pin and a second crank pin, said second part comprising a second part crank web, said first crank pin comprising said conically tapered end portion, said second part crank web comprising said conically tapered recess, said crankshaft comprising a third part crank web, said second crank pin having a second conically tapered end section, said third part crank web having a second conically tapered recess, at least a portion of said second conically tapered end section being inserted into said second conically tapered recess to form a second cone connection, wherein said second crank pin is connected to said third part crank web via said second cone connection, wherein said first adjustment structure surface and said second adjustment structure surface are arranged in a same plane with said second part aligned with said third part, said first adjustment structure surface comprising a first portion, a second portion and a third portion, said first portion being parallel to said third portion, said second portion being perpendicular to said first portion and said third portion, said second adjustment structure surface comprising a second crank web adjustment structure surface first portion and a second crank web adjustment structure surface second portion, said second crank web adjustment structure surface first portion being perpendicular to said second crank web adjustment structure surface second portion.

16. A piston compressor according to claim 15, further comprising:

a screw, said first crank pin having a first crank pin recess, said second part crank web comprising a second part crank web recess, said first crank pin recess being aligned with said second part crank web recess, wherein at least a portion of said screw extends through said first crank pin recess and said second part crank web recess, one portion of said screw engaging said first crank pin and another portion of said screw engaging said second part crank web;

a securing pin, said first crank pin having a second crank pin recess, said second part crank web having a second crank web recess, said second crank pin recess being aligned with said second crank web recess, at least a portion of said securing pin extending through said second crank pin recess and said second crank web recess, one portion of said securing pin engaging said first crank pin and another portion of said securing pin engaging said second part crank web, wherein said first crank pin and said second part crank web are rotationally locked via said securing pin.

17. A piston compressor according to claim 15, further comprising:

another screw, said second crank pin having a second crank pin first recess, said third part crank web comprising a third part web recess, said second crank pin first recess being aligned with said third part web recess, wherein at least a portion of said another screw extends through said second crank pin first recess and said third part web recess, one portion of said another screw engaging said third part crank web and another portion of said another screw engaging said second crank pin;

another securing pin, said second crank pin having a second crank pin second recess, said third part crank web having another third part crank web recess, said second crank pin second recess being aligned with said another third crank web recess, at least a portion of said another securing pin extending through said second crank pin second recess and said another third crank web recess, one portion of said another securing pin engaging said second crank pin and another portion of said another securing pin engaging said third part crank web, wherein said second crank pin and said third part crank web are rotationally locked via said another securing pin.

* * * * *